US011306499B2

(12) United States Patent
Gustason

(10) Patent No.: US 11,306,499 B2
(45) Date of Patent: Apr. 19, 2022

(54) ROLL-UP SPA AND SWIM SPA COVER

(71) Applicant: Donald Jay Gustason, Auburn, CA (US)

(72) Inventor: Donald Jay Gustason, Auburn, CA (US)

(73) Assignee: E2E L.L.C., Incline Village, NV (US)

( * ) Notice: Subject to any disclaimer, the term of this patent is extended or adjusted under 35 U.S.C. 154(b) by 0 days.

(21) Appl. No.: 16/230,530

(22) Filed: Dec. 21, 2018

(65) Prior Publication Data

US 2020/0240161 A1 Jul. 30, 2020
US 2022/0049514 A9 Feb. 17, 2022

Related U.S. Application Data

(63) Continuation of application No. 14/242,777, filed on Apr. 1, 2014, now Pat. No. 10,196,833, which is a continuation of application No. 12/800,984, filed on May 26, 2010, now Pat. No. 8,683,621.

(51) Int. Cl.
*E04H 4/10* (2006.01)

(52) U.S. Cl.
CPC ..... *E04H 4/108* (2013.01)

(58) Field of Classification Search
CPC ..... E04H 4/08; E04H 4/10; E04H 4/108
USPC ..... 4/498
See application file for complete search history.

(56) References Cited

U.S. PATENT DOCUMENTS

| | | | | |
|---|---|---|---|---|
| 8,683,621 | B1 * | 4/2014 | Gustason | E04H 4/10 4/498 |
| 9,725,919 | B1 * | 8/2017 | Vanderpool | E04H 4/108 |
| 9,885,192 | B2 * | 2/2018 | Gustason | E04H 4/108 |
| 9,926,713 | B1 * | 3/2018 | Livingston | E04H 4/082 |
| 2018/0119441 | A1 * | 5/2018 | Livingston | E04H 4/101 |

* cited by examiner

*Primary Examiner* — Huyen D Le
(74) *Attorney, Agent, or Firm* — Ian Burns; ATIP Law

(57) ABSTRACT

A spa cover constructed of layers of pliable insulation encapsulated within a weatherproof vinyl reinforced fabric or a rubber membrane which is attached to rigid square support tubes that run parallel to the short end of the spa. The encapsulated insulation is fastened to the bottom of the square support tubes with corrosion-free nylon anchors which allows the soft insulation assembly to span over the water and rest directly on the spa bartop surface sealing the heat in and keeping debris out. An arched fiberglass rod structure supports a weatherproof rainfly which is permanently affixed to the flat cover assembly to shed rain and debris. The entire assembly is held in place at each end with adjustable straps which stretch the cover from end to end keeping the rainfly taut. Removing the cover to access the spa involves undoing the straps on one end and rolling the cover assembly towards the other end until the desired amount of spa exposure is reached. Covering the spa after use is just the opposite procedure.

20 Claims, 9 Drawing Sheets

ROLL-UP SPA AND SWIM SPA COVER

BENEFIT CLAIM

This application is a continuation of and claims priority to U.S. non-provisional patent application Ser. No. 14/242,777 filed Apr. 1, 2014, which is a continuation of U.S. non-provisional patent application Ser. No. 12/800,984 filed May 26, 2010, now U.S. Pat. No. 8,683,621 the contents and benefit of each of which is herein incorporated by reference.

FIELD OF THE INVENTION

The present invention relates to generally to covers for swim spas.

DESCRIPTION OF RELATED ART

The increased popularity and installation of swim spas in many thousands of residences throughout the world has allowed thousands of people the ability to take advantage of physical therapy while being supported by the buoyant nature of water in their own homes. For many of these people, this type of exercise is prescribed by their doctors to rehabilitate certain physical injuries, to slow the effects of disabling diseases or just to enhance their physical wellness.

Swim spas are generally large enough in size to allow swimming in place, jogging and other exercises in the buoyance of warm or hot water as prescribed by a medical professional. The swim spa is heated and filtered in the same way as a larger swimming pool yet only taking up a small space at the residence. Most swim spas are supplied with covers which are designed to keep the heat in and keep debris out of the water. These covers are rigid, heavy and cumbersome which require two people, in fit condition, to move them on and off the spa. For those who are disabled, elderly or physically unable to move the covers, they have to arrange with others to take care of the cover removal and replacement so they can use the swim spa for rehabilitation, exercises or just physical relaxation. The cover handling is the main complaint of most swim spa users which is why an alternative is needed which will allow just the user to remove the cover by him or herself, or if unable to do even this, would only need one helper who could easily remove and replace the swim spa cover to help keep the heat in and any debris out A secondary problem with the hard covers which are supplied with the spa is the seal between the several sections is typically a flap with Velcro which has to be put in place after the spa covers have been put back on the spa. If done right, the seal between the spa covers is fair and keep most debris and rainfall out of the spa water as long as the spa covers haven't started sagging or warping. The process of doing it right is a nuisance which most people decide is not worth doing. This leads to a higher cost of operation as heat is lost through the gaps and debris is allowed into the water. The end result is more energy is used to keep the spa water heated, more chemical use to treat the dirtier water, longer filtration time and more frequent filter maintenance I have come up with several design ideas for handling the existing hard covers but decided that a different approach was needed which has led to my creation of a roll-up swim spa cover. This cover can be removed and reinstalled by one person in reasonable physical shape and it will seal the spa, keeping heat in, debris out and maintenance down.

SUMMARY OF THE INVENTION

The roll-up swim spa cover is a multi-layered device which is flexible enough to be rolled up upon itself yet strong enough to shed rain and debris while keeping the heat in the water.

The layers of different materials used are supported by square metal or fiberglass tubes which span the approximate 7.5 feet interior width of most swim spas. The layered design and attachment of the layered materials allows for the soft pliable materials to directly contact the bartop of the spa shell which keeps the heat in and the debris out.

The entire swim spa roll up cover is heavy and requires two people to put in place at one end of the spa. Once in place covering the whole spa, a single person can grasp the end of it and start rolling as one would roll up a sleeping bag. The flexibility of the layers of materials allows the cover, once started rolling, to be pushed, like rolling a log, to the end of the spa or anywhere in between. The weight of the layered, flexible material and the square support tubes keeps the cover in place wherever it is rolled to on the spa bartop.

If complete removal of the rolled up cover from the bartop is desired, it can be rolled onto a cradle assembly at the end of the spa. If the cradle assembly is set up with casters, the whole cover roll can be moved out of the way or out of sight.

An important and aesthetic part of the whole assembly is what I call the rainfly cover. It is a weather shield over the top of the whole roll up assembly which when stretched and strapped down on the ends will provide a domed cover which sheds rain, debris, pets, etc The rainfly fabric is precisely tailored to fit on top of ⅜" fiberglass rods which arc from one side of a square support tube to the other end of the same square support tube. The rod attachment to the square support tube is accomplished by the use of a 6 inch long molded plastic insert which is pushed into the end of the hollow square support tube. Since the insert is just slightly smaller than the hollow tube end, it should slide right into the tube ends and be secured in place by short ½" pan head screws to lock it in place. The solid insert will give plenty of structural strength to support the rainfly rods as well as keep the ends of the hollow tubes from being crushed. The inserts have a ⅜" rod which is molded into the plastic and exits the outside cap end making an immediate 170 degree bend back over the top of the square support tube. The rainfly rods have hollow tubes on the ends which slip over the end of the insert rod at a 10 degree arc to the opposite end of the same square support tube with its insert also protruding at a 10 degree angle. The rainfly fiberglass rod is compressed in an arc between the two inserts at the ends of the square support tube which then supports the rainfly material which is stretched over the rods much like a rainfly on a camping tent.

The rainfly fabric has a loop sewn onto it into which the rainfly rods are inserted through before being compressed onto the tube insert end studs. The resulting arc supports the rainfly approximately 8 to 9 inches high in the center when the cover is unrolled but not high enough to impede the rollup flexibility of the cover.

The rainfly structure is then held in place on the ends by straps which when secured, stretches the fabric perpendicular to the support rods, creating a nice, clean, taut, sloped surface which will shed rain and debris. Unlike hard style spa covers, the rollup cover appears soft and flexible which will help to discourage people and pets from trying to walk or sit on it.

DETAILED DESCRIPTION OF THE INVENTION

Figure 1:
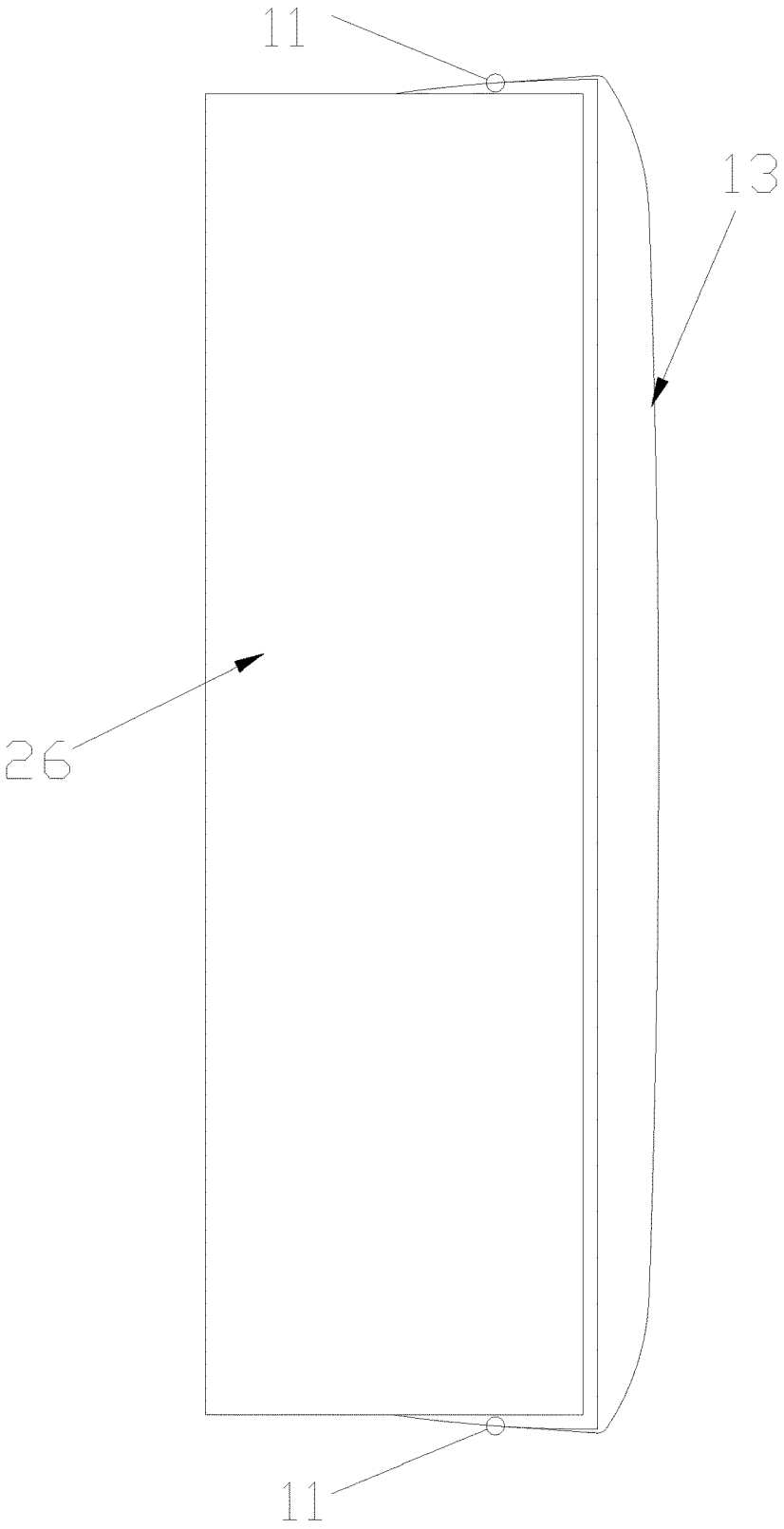
FIG. 1 Side view of a swimspa with cover completely on which shows the domed appearance of the cover when strapped down taut. Side view of a 19 foot long by 7.5 foot wide swimspa rollup cover showing how the cover will be domed when rolled out on the spa and end straps are locked in place stretching the rainfly to a smooth surface from end to end.
Figure 2:
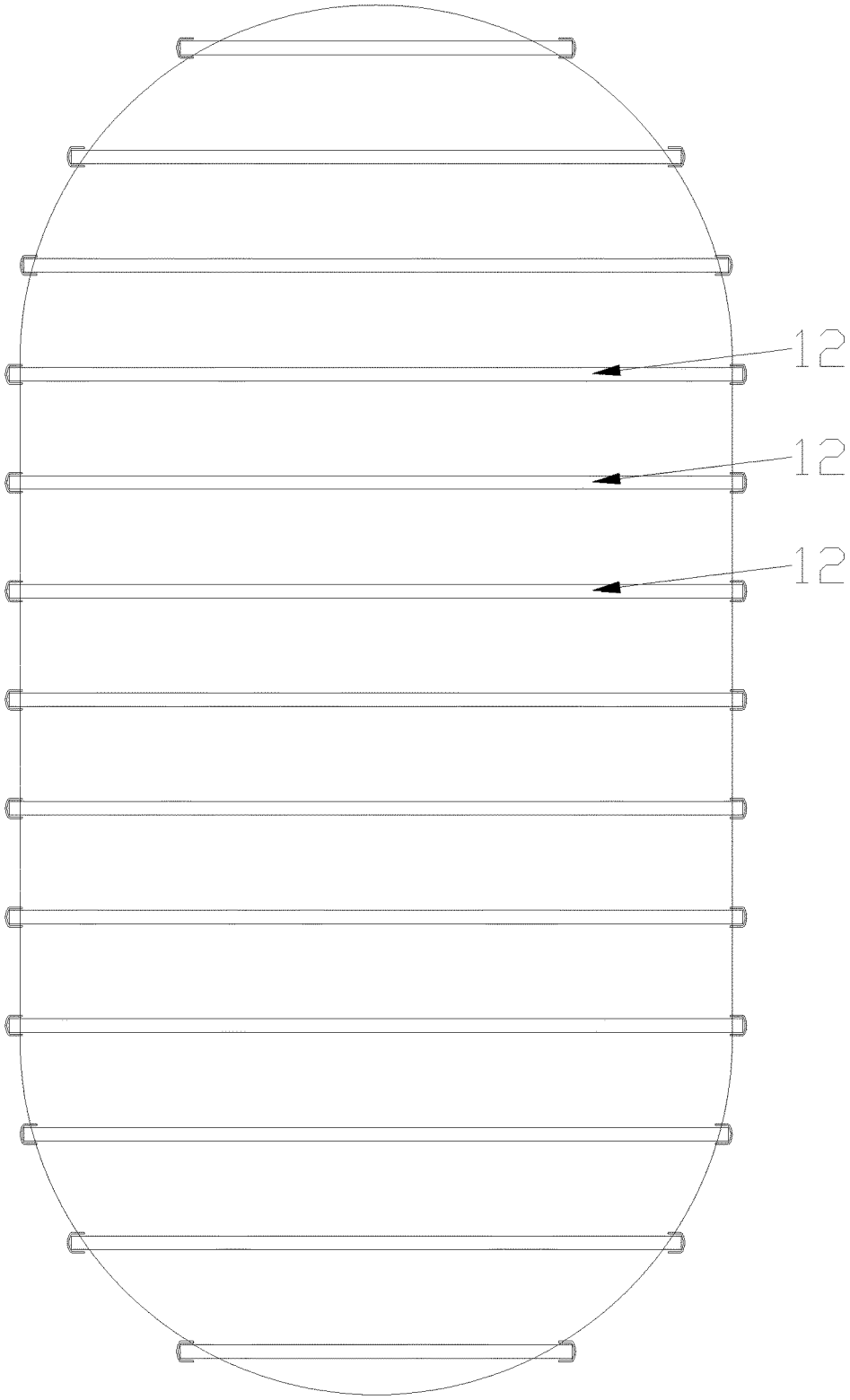
FIG. 2 Plan view of a 19 foot long by 7.5 foot wide swimspa rollup cover without the rainfly which shows the 12" spacing between the square support tubes down the whole length of the spa and perpendicular to its length.
Figure 3:
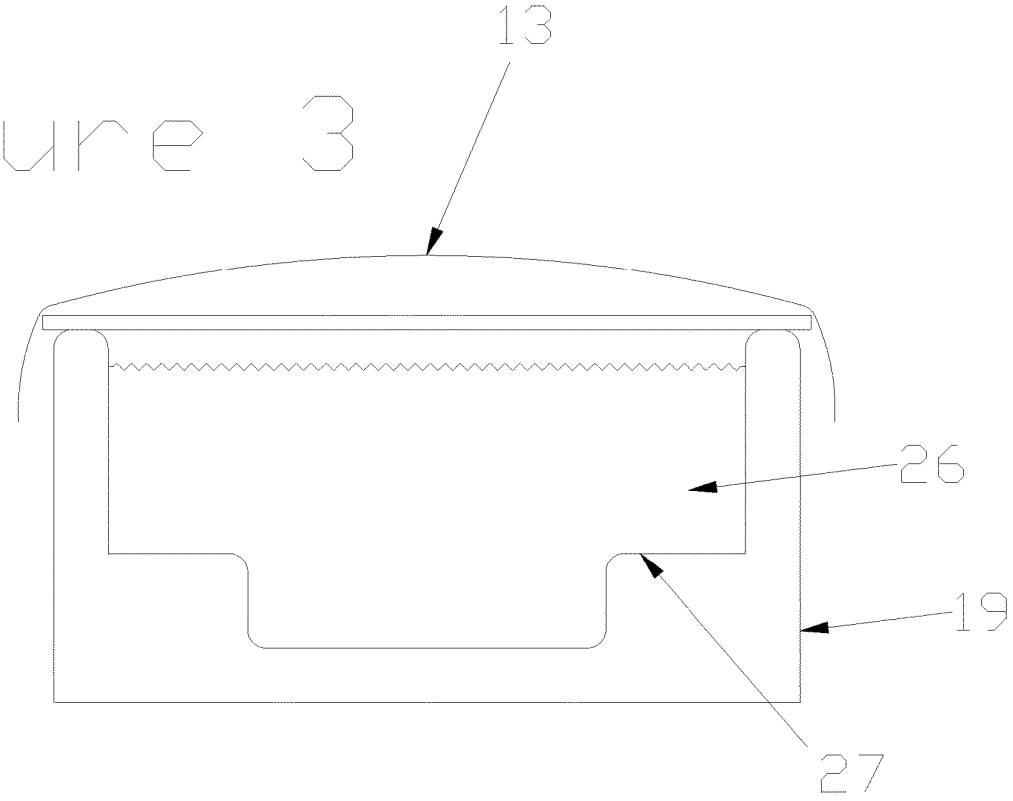
FIG. 3 Section endview of a 19 foot long by 7.5 foot wide swimspa rollup cover showing the arched rainfly assembly from side to side. Please note that FIGS. 1, 2 and 3 show a swimspa with rounded ends. The same construction applies to all other shapes and sizes of spas and swimspas.
Figure 4:
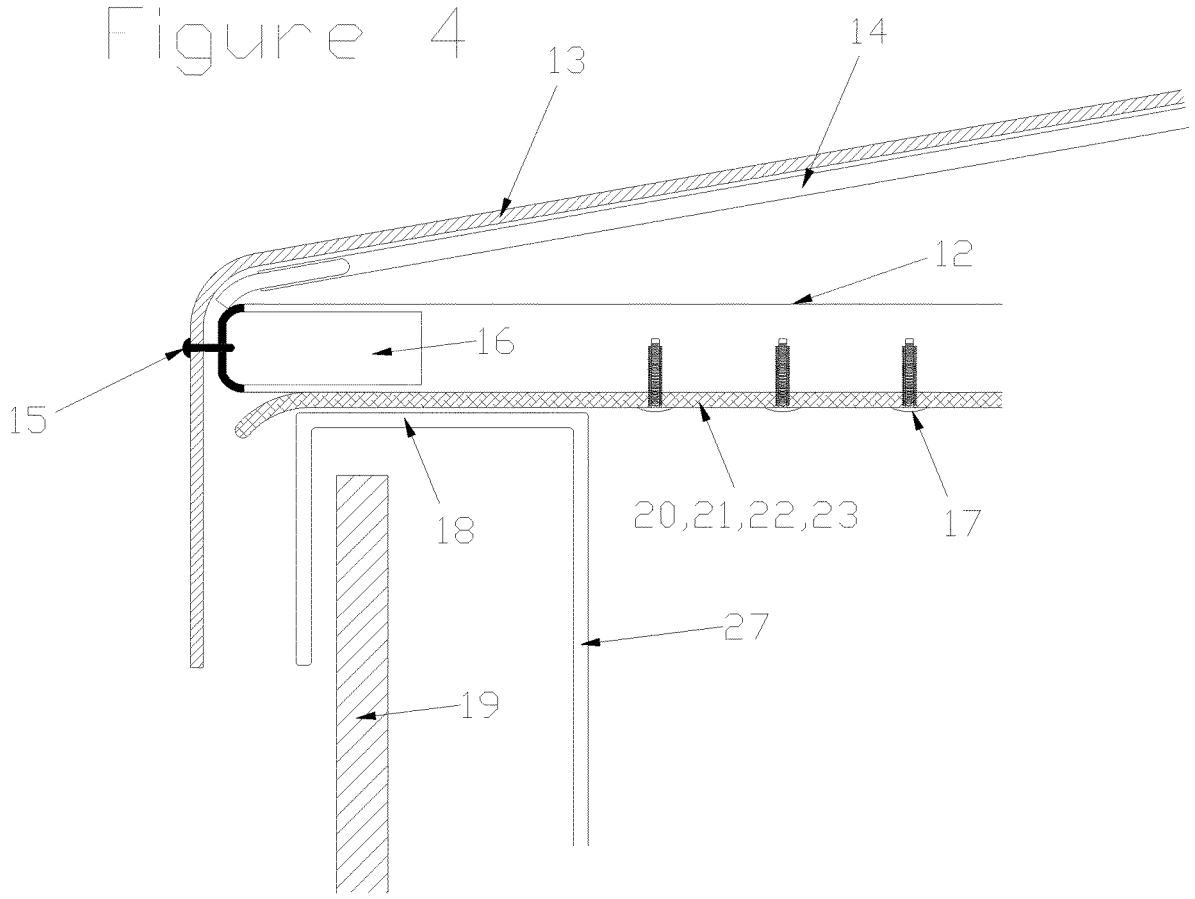
FIG. 4 Detailed cross section view of a complete roll up spa cover as it rests on the spa bar top as viewed from the end of the spa. Starting from the top of the spa shell bartop, the bladder assembly rests directly on top of the bartop and in this area there are not any of the nonmetallic push-in fasteners which may keep a good thermal seal from occurring. The bladder is attached to the bottom of the square support tubes with nonmetallic push-in fasteners so the bladder assembly essentially hangs from the square support tubes over the water surface but not in contact with it. A rainfly support endcap is inserted into the end of the square support tube and fastened in place with a small panhead set screw. The endcap assembly has an attachment built into it so a fiberglass rod can be attached and arched over the width of the spa to the endcap assembly on the other end of the same square support tube. The fiberglass rod supports the water-repellant rainfly which is attached at each of the rainfly support endcap using a stainless steel screw.
Figure 5:
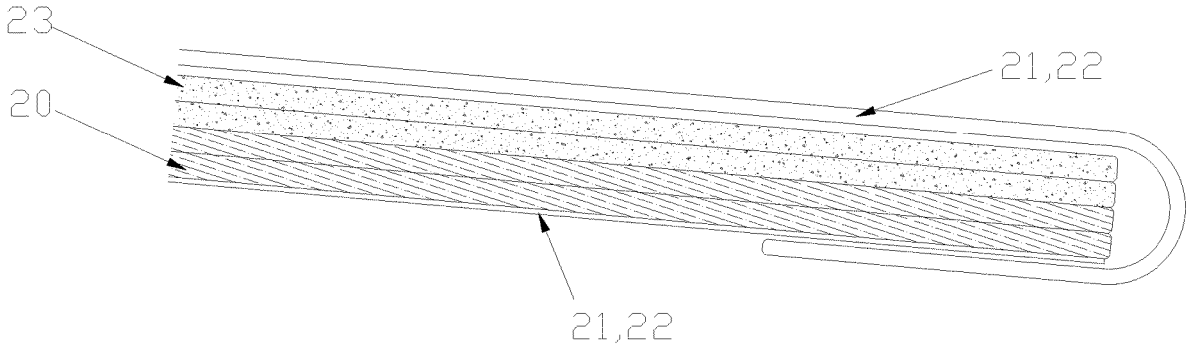
FIG. 5 Cross section view of roll up spa cover materials used in the bladder assembly.
Figure 6:
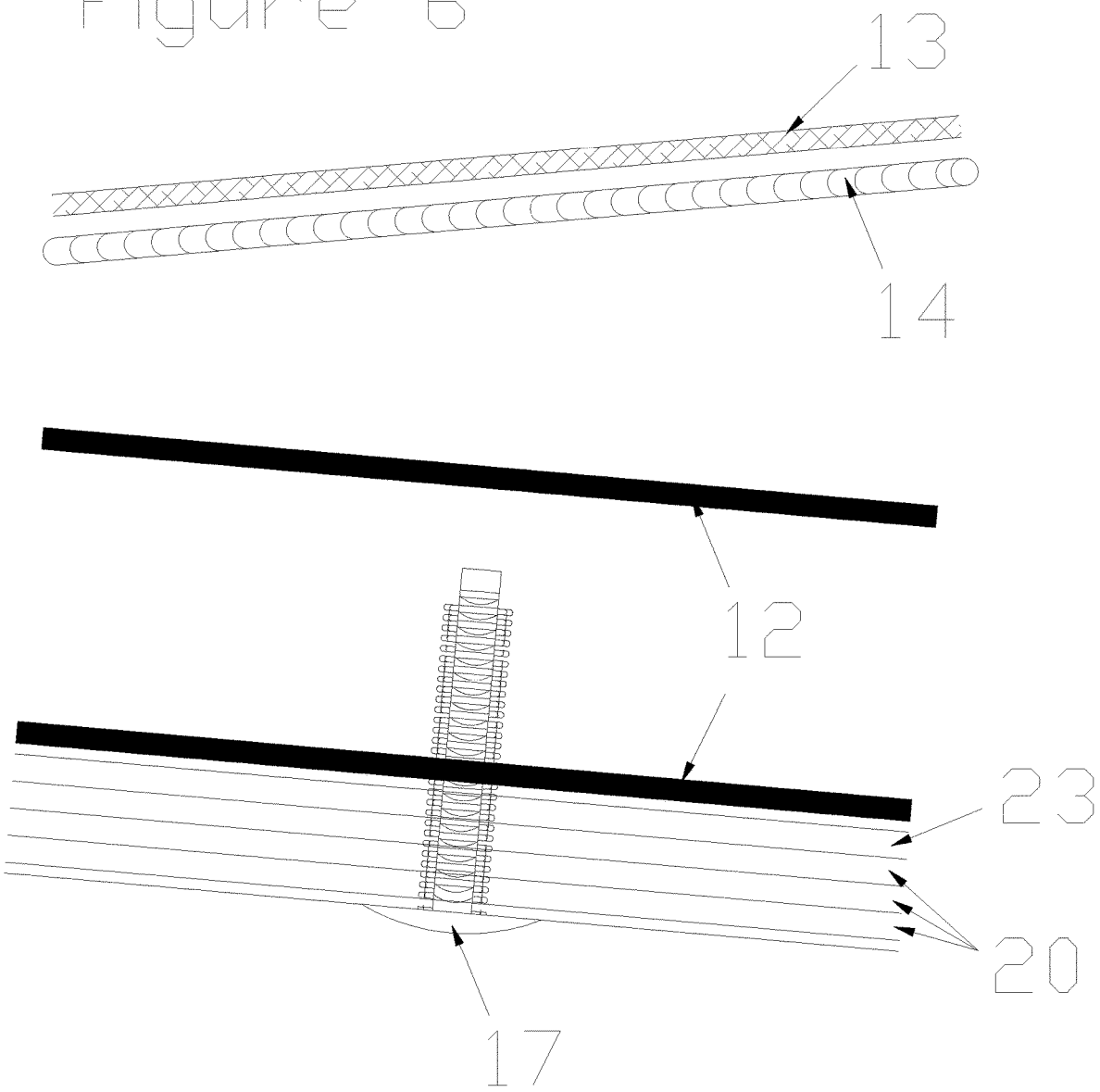
FIG. 6 Cross section view of the bladder assembly attached to square support tubes FIG. 7 Detailed cross section view of complete rollup cover resting on a bartop of spa as viewed from the side of spa.
Figure 7:
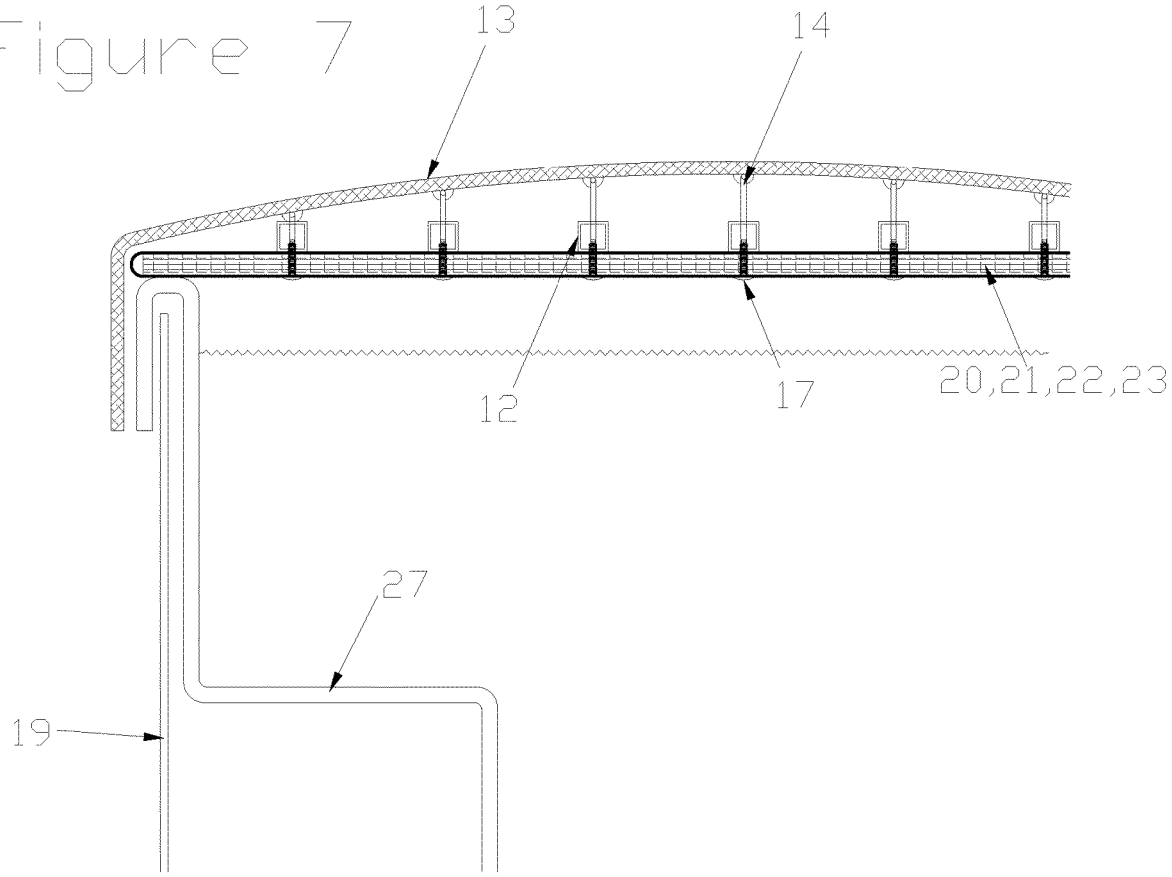
Figure 8:
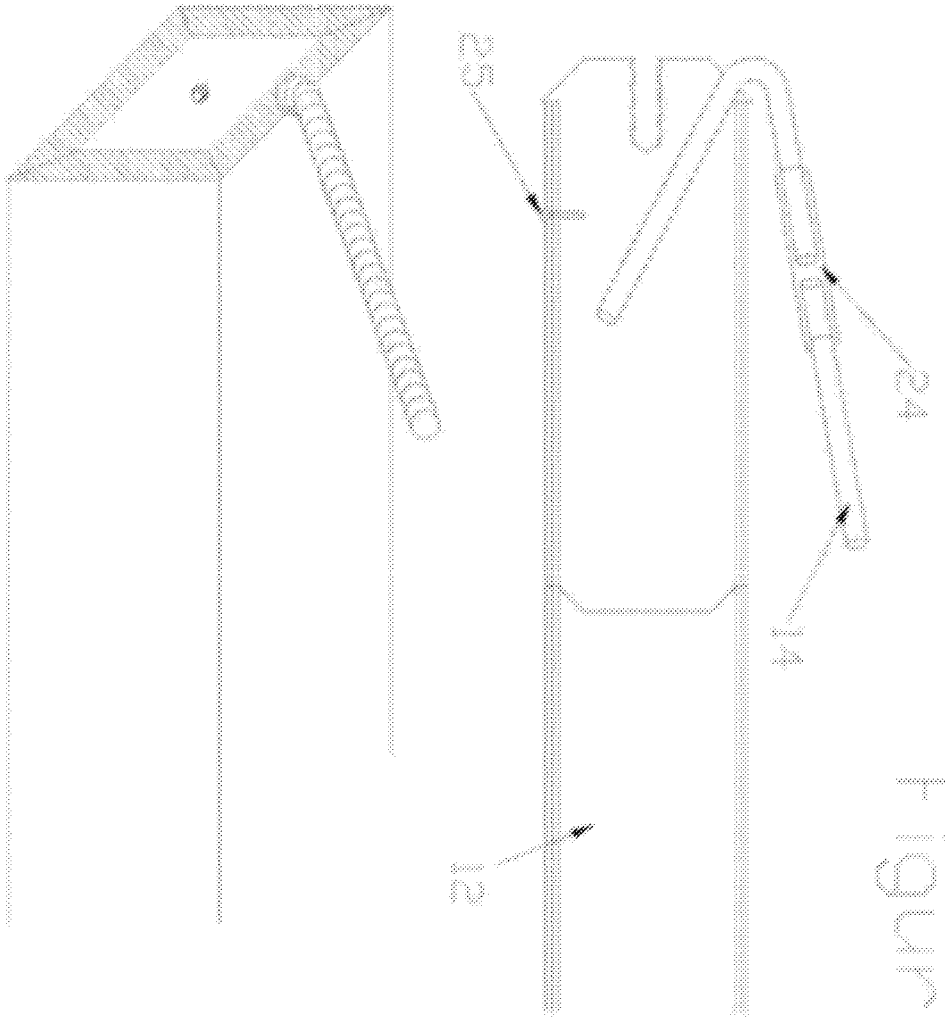
FIG. 8 Detailed drawing of rainfly support endcap application. The endcap assembly is injection molded to fit snuggly in the end of the square support tubes and with finished smooth edges on the side facing the rainfly material to keep friction to a minimum at any contact points. Molded into the endcap insert is a ⅜.sup.th inch thick metal stud or a hollow receiver tube into which the fiberglass rod is inserted and bent between the two attachment points creating an arc. Attachment screws or similar fasteners hold the rainfly which is stretched over the fiberglass rods which arc from side to side over the bladder and square support tube assembly.
Figure 9:
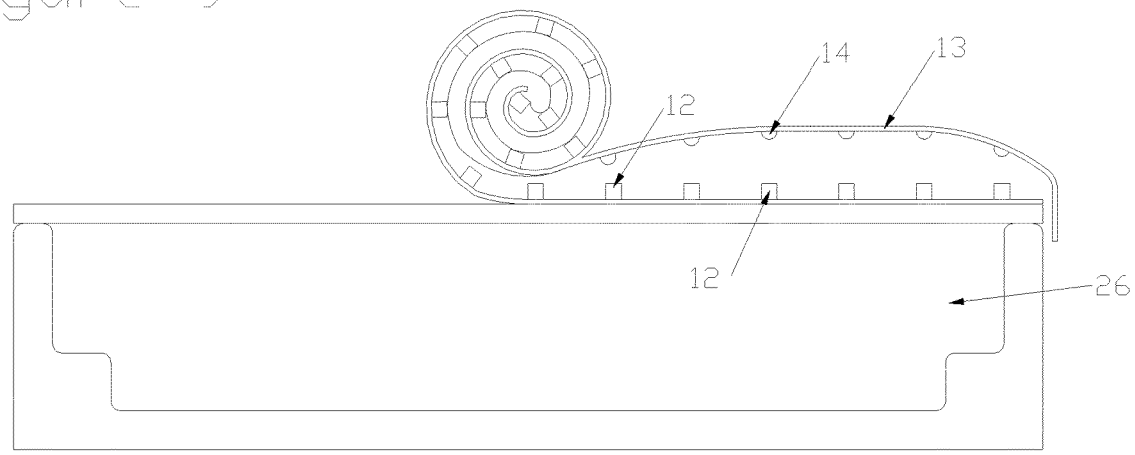
FIG. 9 Section long side view of spa with rollup cover partially removed for FRONT PAGE VIEW.

The roll-up spa cover assembly is described below with reference to the accompanying figures, wherein the noted elements have the following reference numerals in the drawings: 11—length adjustable latching strap; 12—square support tubes; 13—rainfly assembly; 14—round fiberglass rods; 15—stainless steel panhead sheet metal screw; 16—rainfly rod support end cap; 17—nylon Christmas tree fastener; 18—spa shell bartop; 19—spa siding skirt; 20—foam sheeting; 21—EDPM rubber sheet; 22—laminated vinyl fabric; 23—aluminized double bubble insulation; 24—metal coupling; 25—stainless steel panhead sheet metal screw; 26—spa; 27—spa shell.

The manufacture of the roll up spa cover assembly requires several steps and can be made using two different types of flexible, water and chemical resistant fabrics or membranes. STEP 1a uses an EDPM rubber membrane and STEP 2a uses a laminated vinyl fabric.

STEP 1a: Assembly of the "Bladder" using EDPM rubber membrane. A sheet of 60 mil Firestone Ecowhite EDPM rubber membrane is cut so that its' dimensions are 15 inches larger on each side than the spa shell surface area it is supposed to cover. It is important to cut the rubber membrane so that any seams in the material run parallel to the end sides of the spa shell. The rubber membrane is placed white side down on the assembly surface and clamped to hold in place.

A sheet of 5/16.sup.th inch thick aluminized heat-reflective double-bubble insulation is cut so that its' dimensions are 3 inches larger on each side than the spa shell surface area and placed on the initial layer of 60 mil Ecowhite EDPM rubber. This layer of insulation is then temporarily fastened in place so placement of subsequent layers of other materials will not move it off its' centered placement.

Two sheets of ¼" thick polyethylene closed-cell foam are then cut to the exact same size as the aluminized double-bubble insulation which is 3 inches wider than the spa shell dimensions on all sides. The two thinner sheets of polyethylene foam are used instead of a single ½" thick foam because the thinner sheets are more flexible, there is not as much rollup compression and expansion as the thicker foam will experience and the finished surfaces of the foam material provides a stronger, longer-lasting cohesiveness of the closed-cell foam. This ½" thickness of foam provides the minimum air space that the manufacturer of the reflective double-bubble insulation recommends for optimum infrared heat refection back down towards the water in the spa. These two sheets of foam are centered on top of the reflective insulation and temporarily fastened in place.

A final sheet of 45 mil or 60 mil EDPM rubber membrane is cut to the exact same size as the layers of insulation and foam. This layer of rubber is centered on top of the layers of insulation. From the plan view, there should be 12 inches of the bottom (or very first) layer of 60 mil Ecowhite EDPM rubber membrane exposed on all sides of the stack of insulation and rubber.

To complete the bladder assembly, the 12 inches of exposed rubber membrane is folded over the top (or last layer) of rubber and permanently attached using the proper adhesives made specifically for seaming the EDPM rubber membranes together. Wherever there may be an overlap of rubber material due to the shape of the spa shell or corners, the rubber membrane is cut so there won't be any overlap of materials which would prevent the rubber bladder from making a nice tight seal on the spa bartop.

STEP 1b: Assembly of the "Bladder" using a vinyl laminated fabric instead of the EDPM rubber membrane. Vinyl laminated fabric is used in place of the rubber membrane to encapsulate the same layers of insulation in the same layering sequences and the same sizes as was used in making the rubber membrane "Bladder." The laminated vinyl fabric has to be heat welded, glued or sewn together in order to make sheets large enough to create the "Bladder" encasement. It is important that any welded, glued or sewn seams be parallel to the end sides of the spa shell. The end result is that there will be a "bladder" assembly which has the same materials within it and ends up measuring three inches larger on all sides than the spa shell it is being made for.

Now the bladder assembly is complete and if it were placed on top of the spa it was made to fit, it would overlap the outside perimeter edge of the spa by 3 inches on the entire outside perimeter of the spa shell.

STEP 2: Attaching the rigid square support tubes to the bladder. On an assembly table, 1.5".times.1.5".times.96" square tubes are secured onto a rack which holds them 12 inches on center for the entire length of the spa shell. On curved or rounded spa shell ends, the square tubes may be place as close as 6" apart to accommodate the clean look of a tight fitting and attachment points for the rainfly assembly around the perimeter of the curved areas of the spa shell. These tubes which are located in the curved areas will be cut so that they extend the same distance beyond the edge of the bladder as anywhere else on the cover assembly. The tubes on the very ends are either solid or reinforced because these are the most handled by use and will have the rainfly assembly attached with screws The "Bladder" assembly is then positioned on top of the square tubes which have been inserted into the rack. The "Bladder" assembly is placed upside-down on the square tubes so that the side of the bladder which will face the water is now facing up and away from the square tubes.

At each of the square tube locations, a hole-drilling template is positioned directly above the square tubes on which the Bladder now lays. From the center of the Bladder, in intervals of 6 inches, a hole is drilled through the Bladder and into the square support tube. The drill bits are properly sized for whatever fastener type and size is used for maximum holding strength according to the fastener manufacturing specifications. The holes are equally spaced until the holes come within 8 inches of the edge of the Bladder. Fasteners are not installed within the 8 inch wide area of the perimeter because they would compromise the nice seal which the roll-up cover needs in order to meet the energy saving design of a nice tight seal provided by the roll-up cover assembly. The only place where fasteners are installed within the 8 inch perimeter zone would be on the very ends of the cover where square tubes are attached for hold down strap anchoring and rainfly attachment.

Once all the holes are drilled, the hole-drilling template is removed and a nylon push-in locking Christmas tree type fastener is pushed into the holes and into the square support tube which locks the bladder assembly to the tubes. A light tap with a hammer pushes the head of the fastener into the Bladder creating a dimple in the bladder so that none of the fasteners will be able to contact any surface the cover is placed upon. This same process continues until all square tubes have fasteners every 6 inches along its length to a location not within 8 inches to the edge of the bladder assembly.

Now that the bladder assembly is completely attached to the square support tubes the whole assembly needs to be removed from the square tube placement rack and placed square tube side up as it would sit upon the spa shell surfaces.

STEP 3: Attaching the rainfly assembly to the roll-up spa cover assembly. The ends of the square support tubes can now be filled or capped with one of two types of square tube end caps. The caps need to be as smooth as possible to minimize friction points that may over time cause premature wear of the rainfly as it is attached to the square tubes on the capped ends. Regular square tube end caps which just fill the square tube ends and allow for the attachment of the rainfly are inserted into the open ends of the square tubes and fastened to the square tube with a screw so that the end cap cannot fall off the cover assembly. The screw attachment is made on the vertical side of the square tubes to keep the screw heads from ever contacting the bladder assembly or the rainfly assembly. These regular end caps are installed on the square tubes starting on the ends and on every other square tube which should put them every two feet apart.

Rainfly support end caps which are designed to support fiberglass rods, which are compressed into an arc between the ends of the square support tubes, are inserted and fastened in place into the open ends of the square support tubes. The rainfly support end caps are solid plastic blocks that are sized to fit exactly within the square support tubes to a depth of approximately six inches which will give the square support tubes excellent resistance to being crushed and give extra torque strength since these are supporting the rainfly. A ⅜.sup.th inch thick zinc plated steel rod approximately six inches long is bent to an acute angle of 20 degrees so that two inches of it are on one side of the tight bend and the remaining four inches are on the other side. The four inch side of the rod can be deformed so that when molded into the plastic block that it will be anchored in place so that the two inch side of the rod exits the plastic block and points at a 20 degree angle back over the top of the filler block. The rainfly support end cap is then inserted into the ends of the square support tubes so that the metal rod is pointing directly over the top of the square tube and directly towards the other end of the same support tube. As with the regular end caps, the rainfly support end caps are screwed to the square support tubes on the vertical sides of the square support tubes.

Once all the open ends of the square support tubes are filled in, the fiberglass rods are compressed into place between the receiver for the fiberglass rod on one side of the spa cover assembly and the other side, directly above and parallel to the square support tube. The arc height must be approximately 9 inches so that when the cover assembly is rolled up, the arched fiberglass rod fits nicely between the square support tubes which will not hinder the roll-up process. Once all the rods are put in place, looking down the ends of the cover assembly, all of the fiberglass rods need to arc at the same height except the two rainfly rods at the ends of the cover assembly which may only peak out seven inches high which will give the roll-up spa cover a nice sleek appearance once the rainfly is attached.

The rainfly is a water-resistant reinforced vinyl fabric which is made to perfectly fit on top of the arched fiberglass rods and attach along the spa perimeter which gives the roll-up spa cover its' sleek appearance and weather protection. The rainfly is designed to fit snuggly over the fiberglass rods and to be attached to the square tube end caps which will keep the rainfly fabric taut. In order to keep the rainfly support rods in the proper location, a series of loops which are sewn, welded or heat seamed are added to the underside of the rainfly at the highest point so that the fiberglass rods can be inserted into the loop directly above the square support tubes. Once this has been done for each of the fiberglass rods, each rod can then be inserted into the rainfly support receivers on the rainfly support square tube on either end. The rainfly can then be centered over the arched rods and attached to the square tube endcaps.

The rainfly should now be attached to the square tube endcaps using #8.times.¾" Phillips Truss head stainless steel screws. Starting at the middle of the cover, the rainfly fabric will be centered from side to side on top of the fiberglass support rods and fastened onto one of the center square tube endcaps with a ⅜th" stainless steel washer to help spread out the pressure of the screw on a larger area of fabric. Now on the opposite end of the same center square tube the fabric will be pulled taut and fastened to the endcap with a #8.times.¾" SS Phillips truss screw, ⅜" SS washer and two ½" nylon washers. The order the hardware is applied is one nylon washer between the rainfly and rainfly support end cap, then another nylon washer so that the fabric is sandwiched between the nylon washers. The screws with a washer will be driven into predrilled holes in the endcaps far enough to bottom out the screw heads onto the washers which in turn compress the fabric onto the endcaps. This procedure is duplicated from the center down to the ends. A key step in this process is to ensure that as the rainfly is stretched over the fiberglass rods and attached to the endcaps that the fiberglass rods are straight up and down as viewed from the side endcap positions at every square tube which supports the rainfly assembly.

The rainfly attachment to the rollup spa cover on the very end square tubes on a square ended spa is done using the same hardware used on the attachment of the rainfly on the ends of the square tube except the screws will penetrate every 6 inches starting from the center into the long side of the square tube facing away from the spa. On round ended spas, the rainfly attachment is at the ends of the square tubes as they extend just beyond the bladder assembly every six inches along the perimeter of the circular spa shape.

Now that the rainfly is attached to the framework at the edges of the roll-up cover, the adjustable straps which will keep the rainfly taut from end to end needs to be attached to the square tubes at each end of the cover assembly. There should be a main strap at the center of each end which is attached to the end square tube with two #8.times.¾" SS Phillips truss screws. The strap should be sufficient in length to allow for locking length adjustment hardware to be installed somewhere between the bottom of the roll-up cover and the spa siding or decking around the spa. When these two main straps are attached, the spa cover rainfly should be pulled taut from one end to the other and latched down. Finally at two locations on either side of the main straps and at desired intervals down the sides, locking hold-down straps are added for child safety and extra wind restraints. The appearance of the roll-up cover assembly, when completely unrolled and strapped down should be a taut slightly domed structure covering the entire spa. With a 6 inch valence attached to the rainfly and hanging around the entire perimeter, the spa shell is protected from the weather and the appearance is clean.

The assembly of the roll-up spa cover is now complete and ready for easy roll-on and roll-off use for many years to come.

What is claimed is:

1. A roll-up spa cover comprising:

(A) a multi-layer flexible insulation sheet structure comprising at least two flexible layers, the sheet structure sized to at least cover a top of a spa;

(B) a plurality of support members attached to the insulation cover in a parallel spaced relationship;

(C) a plurality of flexible rods that are supported by the plurality of support members, one or more of the flexible rods, in use, forming an arc above the insulation cover; and (D) a rain fly supported by the plurality of flexible rods.

2. The roll-up spa cover of claim 1 wherein the insulation sheet structure comprises;

(A) at least one support layer to which the plurality of support members are attached;

(B) at least one heat-reflective insulation layer disposed on a side of the support layer opposite to the plurality of support members; and (C) at least one spacer layer.

3. The roll-up spa cover of claim 2 wherein the at least one spacer layer comprises at least two layers of closed-cell foam.

4. The roll-up spa cover of claim 3 wherein the layers of closed-cell foam have a maximum thickness of ¼".

5. The roll-up spa cover of claim 2 wherein the at least one heat-reflective insulation layer comprises at least one aluminized double-bubble insulation layer.

6. The roll-up spa cover of claim 1 wherein a height of the arc of the flexible rods is less than a spacing between the support members to facilitate the cover being rolled up.

7. The roll-up spa cover of claim 1 comprising a plurality of end caps that are disposed in an end of the support members.

8. The roll-up spa cover of claim 7 wherein the plurality of end caps comprise a plurality of rain fly support end caps comprising:

(A) a cap portion inserted into an end of the support member; and (B) a bent rod protruding from the cap portion, the bent rod extending upward and inward from an end of the support member and providing an anchor for an end of a flexible rod.

9. The roll-up spa cover of claim 8 comprising the rain fly support end cap in each end of at least one support member and a flexible rod extending between the bent rod of the rain fly support end cap at end of the support member, wherein the flexible rod is compressed between the bent rods at each end of the support member such that the flexible rod is caused to arc between the ends of the support member.

10. A roll-up spa cover comprising:

(A) insulation cover means for covering and insulating a spa;

(B) rain fly means for providing rain cover to the insulation cover means;

(C) flexible support means for providing support to the rain fly means in arced relationship over the insulation cover means;

(D) support member means attached to the insulation cover means for providing support to the flexible support means.

11. The roll-up spa cover of claim 10 comprising end cap means disposed within the support member means for attaching the rain fly means.

12. The roll-up spa cover of claim 11 wherein the end cap means comprises bent rod means for securing the flexible rod means between ends of the support member means.

13. A method for rolling up a spa cover, the spa cover comprising:

(A) a multi-layer flexible insulation sheet structure comprising at least two flexible layers, the sheet structure sized to at least cover a top of a spa;

(B) a plurality of support members attached to the insulation cover in a parallel spaced relationship, the plurality of support members extending laterally across the spa cover;

(C) a plurality of flexible rods that are supported by the plurality of support members, one or more of the flexible rods, in use, forming an arc above the insulation cover; and (D) a rain fly supported by the plurality of flexible rods;

the method comprising rolling the spa cover from a first longitudinal end to an opposite longitudinal end such that the plurality of flexible rods are disposed within a spacing between the support members.

14. The method of claim 13 comprising rolling the spa cover onto a cradle assembly.

15. A method for manufacturing a spa cover comprising at least the following steps, not necessarily in the order shown:

(A) providing a membrane dimensioned to fit over a top of a spa;

(B) attaching a plurality of rigid support members to the membrane laterally across the membrane in spaced relationship relative to each other;

(C) securing a plurality of flexible support rods between ends of a plurality of the plurality of rigid support members flexible rod such that the support rods form an arc across the membrane; and (D) securing a fly over the plurality of flexible support rods.

16. The method of claim 15 wherein securing the plurality of flexible support rods comprises locating support end caps in ends of a plurality of the rigid support members and securing the flexible support rods to the support end caps.

17. The method of claim 16 wherein securing the flexible support rods to the support end caps comprises engaging ends of the flexible support rods with angled rods extending outward of the support end caps.

18. The method of claim 17 comprising compressing the flexible rods between the angled rods such that the flexible rods form an arc.

19. The method of claim 15 comprising inserting rainfly securing end caps in ends of a plurality of the plurality of rigid support members and securing the fly to the rainfly securing end caps.

20. A method comprising:

(A) providing a spa cover to an end user of a spa, the spa cover being adapted to be removed from a spa by rolling the cover, the spa cover comprising:

(a) a multi-layer flexible insulation sheet structure comprising at least two flexible layers, the sheet structure sized to at least cover a top of a spa;

(b) a plurality of support members attached to the insulation cover in a parallel spaced relationship;

(c) a plurality of flexible rods that are supported by the plurality of support members, one or more of the flexible rods, in use, forming an arc above the insulation cover; and (d) a rain fly supported by the plurality of flexible rods.

* * * * *